US006263986B1

(12) United States Patent
Massner et al.

(10) Patent No.: US 6,263,986 B1
(45) Date of Patent: Jul. 24, 2001

(54) HYDRAULIC DRILLING JAR

(75) Inventors: Perry E. Massner, Calgary (CA); Darren L. Stang, Covington, WA (US)

(73) Assignee: Canadian Downhole Drill Systems, Inc. (CA)

( * ) Notice: Subject to any disclaimer, the term of this patent is extended or adjusted under 35 U.S.C. 154(b) by 0 days.

(21) Appl. No.: 09/538,138

(22) Filed: Mar. 29, 2000

(51) Int. Cl.[7] ..... E21B 31/113

(52) U.S. Cl. ..... 175/297

(58) Field of Search ..... 175/296, 293, 175/297, 299, 304, 317; 166/178, 99, 301

(56) References Cited

U.S. PATENT DOCUMENTS

| | | | | |
|---|---|---|---|---|
| 5,007,479 | | 4/1991 | Pleasants et al. | 166/178 |
| 5,033,557 | | 7/1991 | Askew | 175/297 |
| 5,123,493 | | 6/1992 | Wenzel | 175/297 |
| 5,174,393 | * | 12/1992 | Roberts et al. | 175/297 |
| 5,918,689 | * | 7/1999 | Roberts | 175/297 |

FOREIGN PATENT DOCUMENTS

| | | | | |
|---|---|---|---|---|
| 1005810 | * | 2/1977 | (CA) | 175/297 |

* cited by examiner

*Primary Examiner*—Robert E. Pezzuto
(74) *Attorney, Agent, or Firm*—Merek & Voorhees

(57) ABSTRACT

A hydraulic drilling jar for use in association with downhole drilling and adaptable for connection between components of a drill string or the like. The hydraulic drilling jar generally comprises an outer generally hollow hydraulic housing, an inner mandrel assembly, an anvil portion, a hammer portion, and a hydraulic valve. The hydraulic housing has an enclosed first end and an open second end with the first end releasably securable to a first component of the drill string. The mandrel has a first end releasably securable to a second component of the drill string and a second end slidably receivable within the open second end of the hydraulic housing to forming an internal fluid chamber between the mandrel and the housing. The mandrel is also slidable within the outer housing from a contracted position to an extended position. The hydraulic housing and the mandrel operatively connect the first and second components of the drill string. One of the anvil and the hammer portions is situated on the hydraulic housing and the other is situated on the mandrel assembly. The hydraulic valve is received around the second end of the mandrel and within fluid chamber. Upon extension of the drilling jar through the application of a tensile load between the housing and the mandrel, the valve seats against the housing and the mandrel to bifurcate the fluid chamber into first and second portions while pressurizing the first portion of the fluid chamber to place the hydraulic drilling jar in a cocked configuration. Further extension of the hydraulic drilling jar causes the valve to become unseated allowing for rapid de-pressurization of the first portion of the fluid chamber and a resulting rapid further extension of the hydraulic drilling jar with high impact loading of the anvil and the hammer portions.

8 Claims, 4 Drawing Sheets

HYDRAULIC DRILLING JAR

FIELD OF THE INVENTION

This invention relates to a hydraulic drilling jar, and in particular a hydraulic drilling jar adaptable for connection between the components of a drill string used in downhole drilling.

BACKGROUND OF THE INVENTION

In downhole drilling operations, whether it be when drilling for oil, gas, or water, or for civil, geological or mining engineering purposes, typically a drill string is used to connect the surface rig to the downhole bit or motor. The drill string is usually comprised of a number of tubular sections that are threaded together such that its length can be varied as needed.

During the drilling operation the drill string can sometimes become wedged against the wall of the well casing or bore hole, often requiring the application of a high impact tensile load in order to free the wedged string. In other instances high impact tensile loading may be necessary to retrieve downhole tools that have been "set" within the well, or that otherwise have become lodged within the casing. To provide the application of high impact tensile loading for such purposes, others have developed mechanical or hydraulic jars that are capable of "jarring" or impacting the drill string in an upward or downward direction. In the case of an upwardly operating jar, a high impact load is directed upwardly to retrieve tools or dislodge a wedged drilling string. In the case of a downwardly directed jar, the impact loading is typically utilized to "set" a variety of different downhole tools with the well.

Unfortunately, such existing jars generally tend to be relatively complex mechanical and hydraulic devices that add significant capital expense to the drilling operation, and that are more prone to becoming jammed and to failure.

SUMMARY OF THE INVENTION

The invention therefore provides a hydraulic drilling jar which addresses some of the deficiencies in prior developed products. The invention provides a simple structure capable of applying high impact tensile loading to a drill string without excessive complexity, costs and with a high level of dependability.

Accordingly, in one of its aspects the invention provides a hydraulic drilling jar for use in association with downhole drilling and adaptable for connection between components of a drill string or the like, the hydraulic drilling jar comprising an outer generally hollow hydraulic housing having an enclosed first end and an open second end, said first end releasably securable to a first component of the drill string; an inner mandrel assembly having a first end releasably securable to a second component of the drill string and a second end slidably receivable within said open second end of said hydraulic housing thereby forming an internal fluid chamber between said mandrel and said housing, said mandrel assembly slidable within said outer housing from a contracted position to an extended position, said hydraulic housing and said mandrel assembly operatively connecting the first and second components of the drill string; an anvil portion and a hammer portion, one of said anvil and said hammer portions situated on said hydraulic housing and the other of said anvil and said hammer portions situated on said mandrel assembly; and, a hydraulic valve received around said second end of said mandrel assembly and within said fluid chamber, wherein upon extension of said drilling jar through the application of a tensile load between said housing and said mandrel, said valve seats against said housing and said mandrel and thereby bifurcates said fluid chamber into first and second portions while pressurizing said first portion of said fluid chamber to place said hydraulic drilling jar in a cocked configuration, such that further extension of said hydraulic drilling jar through the continued application of a tensile load causes said valve to become unseated allowing for rapid de-pressurization of said first portion of said fluid chamber and a resulting rapid further extension of said hydraulic drilling jar with high impact loading of said anvil and said hammer portions.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
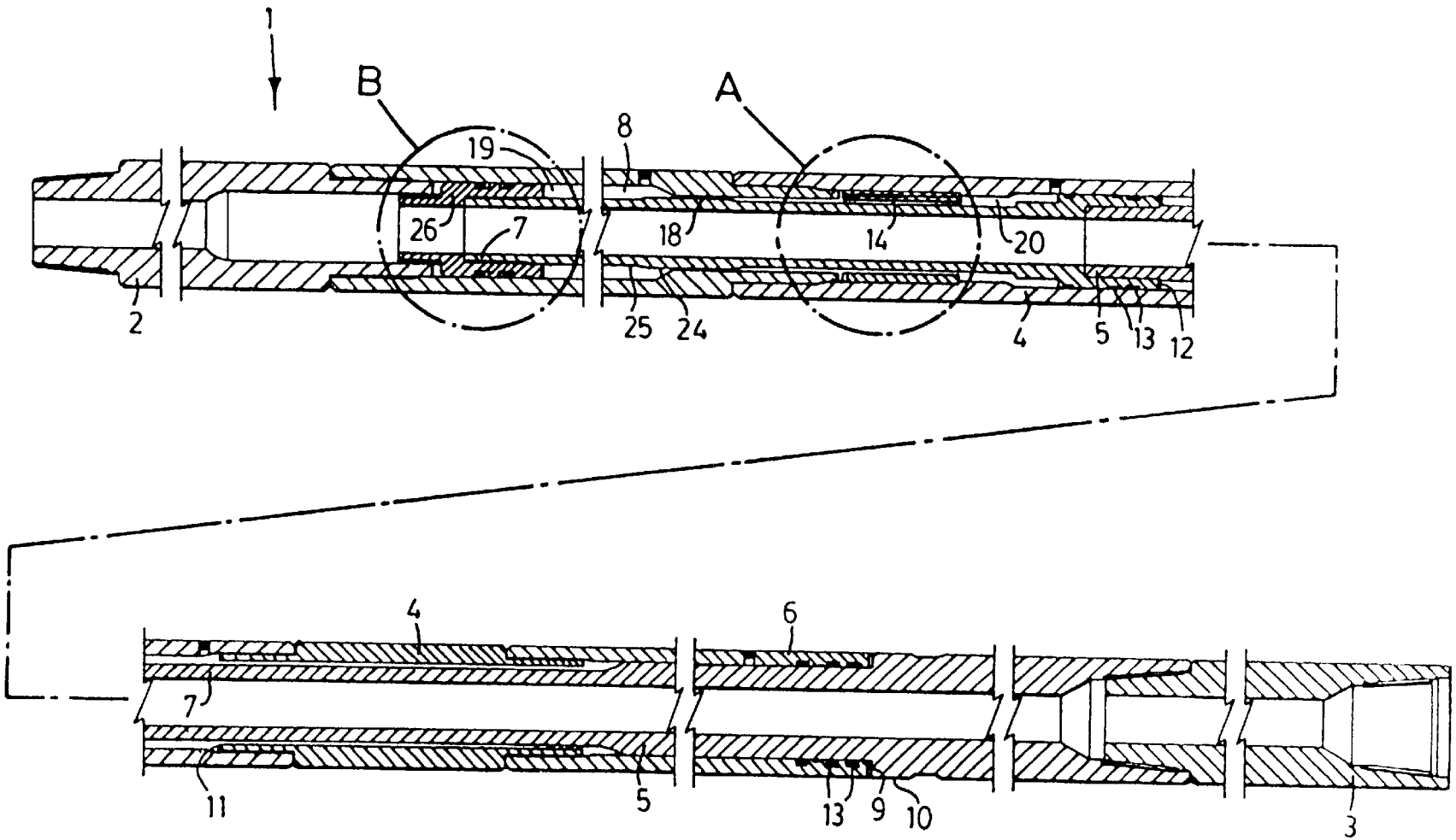
FIG. 1 is a side sectional view of a preferred embodiment of the hydraulic drilling jar of the present invention in a contracted configuration.
Figure 3:
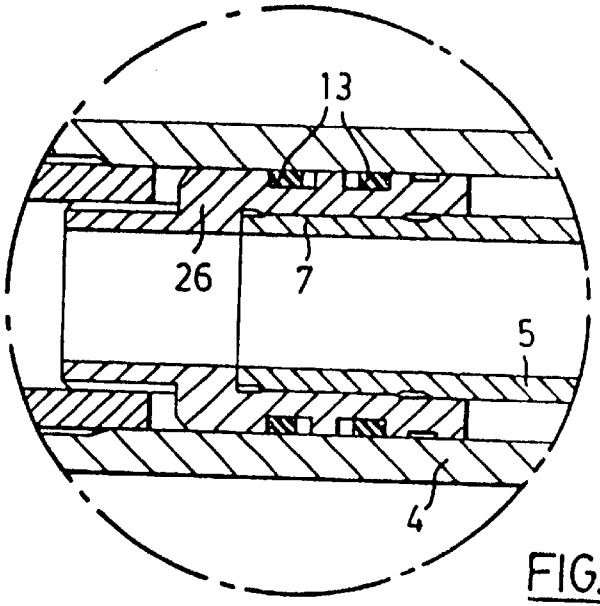
FIG. 3 is an enlarged view of portion "B" of FIG. 1.
Figure 2:
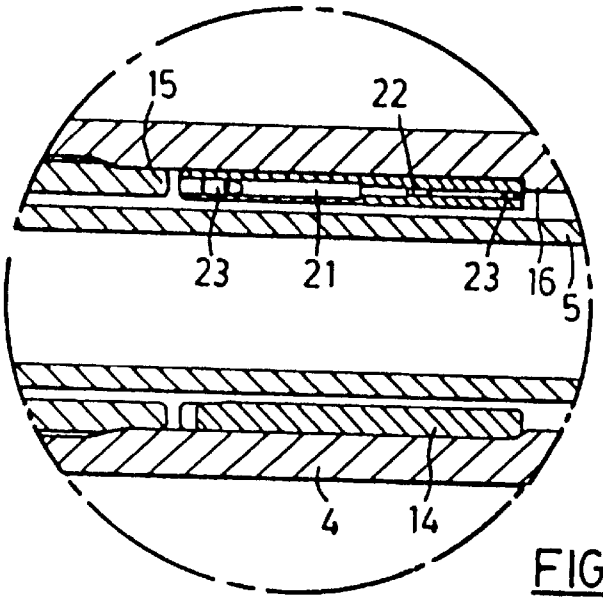
FIG. 2 is an enlarged view of portion "A" of FIG. 1.
Figure 4:
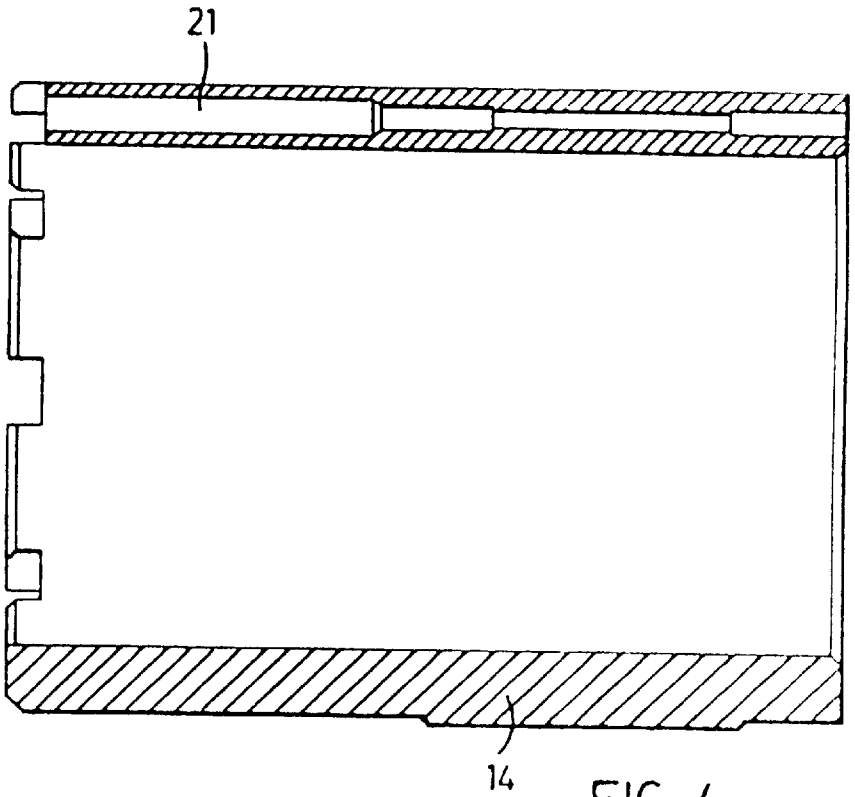
FIG. 4 is a side sectional view of the hydraulic valve of the drilling jar shown in FIG. 1.
Figure 5:
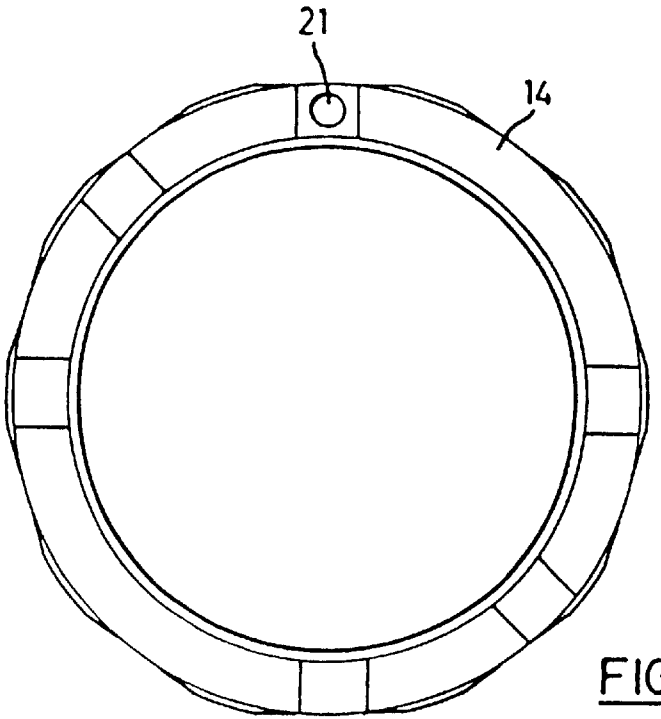
FIG. 5 is an end view of the hydraulic valve shown in FIG. 4.

The present invention may be embodied in a number of different forms. However, the specification and drawings that follow describe and disclose only some of the specific forms of the invention and are not intended to limit the scope of the invention as defined in the claims that follow herein.

In the attached drawings, the hydraulic drilling jar according to the present invention is noted generally by reference numeral 1. Hydraulic drilling jar 1 is generally elongate in structure having a lower end 2 and an upper end 3. Ends 2 and 3 are adaptable for connection between components of a drill string or the like. Most commonly, ends 2 and 3 would be fitted with internal and/or external threads so that they may be threadably received between sections of a drill string. However, a variety of alternate connection means could equally be utilized while remaining within the broad scope of the invention. Since hydraulic drilling jar 1 will in most instances be used in a downhole drilling environment, it is preferably made of a corrosion resistant, high strength steel, as would commonly be used for drill strings or other downhole tools.

Hydraulic drilling jar 1 is comprised generally of a generally hollow hydraulic housing 4 and an inner mandrel assembly 5. In the embodiment shown in the attached figures, housing 4 has an enclosed first end that corresponds to lower end 2 of the jar and that enables the housing to be releasably securable to a first component of a drill string. Hydraulic housing 4 further has an open second end 6 that allows for communication with its generally hollow interior.

Similarly, in the embodiment shown in the attached drawings, inner mandrel assembly 5 has a first end corresponding with upper end 3 of the jar that allows the mandrel to be releasably securable to a second component of a drill string.

A second end 7 of mandrel 5 is formed so as to be slidably receivable within open end 6 of hydraulic housing 4. Second end 7 includes a portion 24 having a diameter that closely approximates the internal diameter of hydraulic housing 4 but that allows for sufficient clearance to permit movement of the mandrel within the housing. Second end 7 further includes a reduced diameter portion 25 that is dimensionally smaller than the interior diameter of hydraulic housing 4 thereby forming an annular space between the mandrel and the housing when second end is slidably received into open end 6. In addition, second end 7 terminates in an enlarged portion or cap 26 that also has a diameter closely approximating the internal diameter of hydraulic housing 4 and that forms a generally sealing relationship therewith. Enlarged portion 26 would typically be in the form of a cap or plug portion threadably received upon, or otherwise attached to, the terminal end of the mandrel.

With second end 7 of mandrel 5 slidably received within hydraulic housing 4 there will be formed an internal fluid chamber 8 generally defined by the interior surface of hydraulic housing 4, the exterior surface of reduced diameter portion 25, portion 24 of mandrel 5, and the enlarged end portion or cap 26. In the preferred embodiment, fluid chamber 8 is filled with hydraulic oil or a similar material and a series of seals 13 are utilized within both hydraulic housing 4 and on mandrel 5 in order to help prevent the loss of fluid from the chamber.

It will thus be appreciated that by means of the above described structure, mandrel 5 is moveable within housing 4 from a position where hydraulic drilling jar 1 is contracted and the mandrel received deep within the hollow interior of housing 4, to a position where the jar is in an extended configuration and the mandrel is at least partially withdrawn from the housing. When jar 1 is fully contracted the upper most portion 9 of open end 6 of the hydraulic housing bears against an external radial flange 10 on the upper end of mandrel 5. The abutment of upper most portion 9 against flange 10 provides a physical limitation to the contraction of the hydraulic drilling jar. This structure also enables the jar to transfer compressive forces, that are exerted upon the drill string by the above ground drilling rig, through the jar, into the lower section of the drill string, and ultimately to the downhole motor, bit or other tool.

Hydraulic drilling jar 1 further includes an anvil portion and a hammer portion. In the embodiment shown in the attached drawings the anvil portion comprises an outwardly extending radial shoulder 12 located on the outer surface of mandrel 5 while the hammer portion comprises an inwardly extending radial shoulder 11 upon hydraulic housing 4. However, the relative locations of the anvil and hammer portions could also be reversed, with the anvil situated on the hydraulic housing and the hammer positioned on the mandrel, while not materially affecting the overall operation of the invention. In either event, upon extension of hydraulic drilling jar 1 the anvil and hammer portions will eventually come into contact and prevent further extension or relative longitudinal movement between the mandrel and the housing.

The described structure of housing 4 and mandrel 5 will therefore be seen to provide a mechanism to operatively connect components of a drill string that may be attached to lower end 2 and upper end 3 of the drilling jar. By means of the interaction of upper most part 9 of open end 6 and radial flange 10, as well as a hammer 11 and an anvil 12, relative longitudinal movement (from either the application of a tensile or compressive force) will be controlled. Through controlling longitudinal movement in this manner there will also be provided a mechanism to allow for the transmission of tension or compression through the drilling jar. There is also provided a mechanism that is capable of applying an impact force to the jar, as is described in more detail below.

As also shown in FIG. 1, hydraulic drilling jar 1 further includes a hydraulic valve 14 that is positioned within fluid chamber 8 when second end 7 of mandrel 5 is received within the hollow interior of hydraulic housing 4. In a preferred embodiment hydraulic valve 14 is generally cylindrical in nature, having an outside diameter that closely approximates the inside diameter of at least a portion of hydraulic housing 4 such that the valve fits snugly against the internal diameter of at least that portion. Hydraulic valve 14 is held in position along the interior surface of the hydraulic housing through a pair of opposed shoulder members 15 and 16, respectively. To the extent that there may tend to be any relative movement between valve 14 and hydraulic housing 4 during operation of jar 1, shoulders 15 and 16 will limit such movement in an axial direction.

Figure 6:
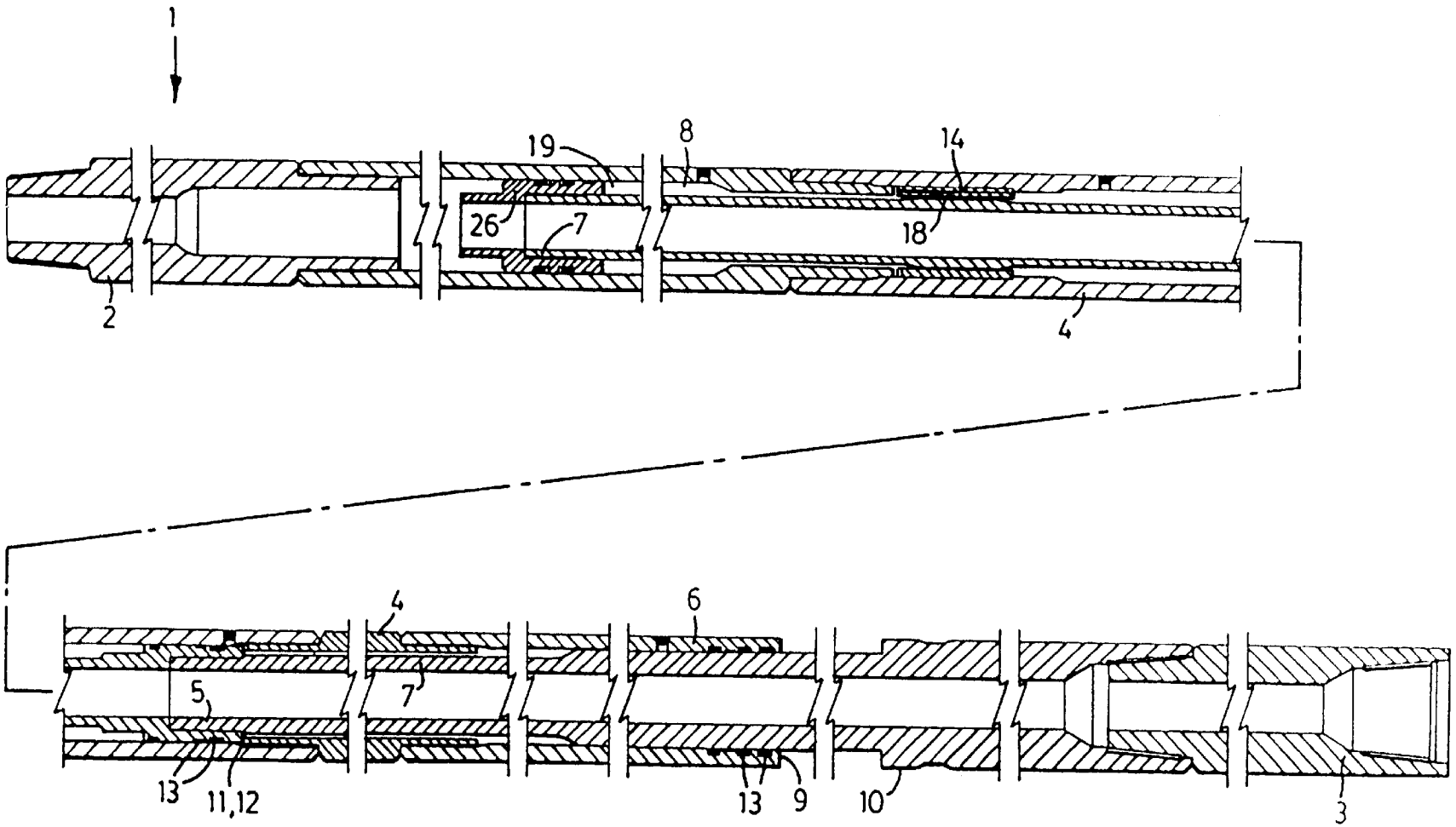
FIG. 6 is a side sectional view of the hydraulic drilling jar of FIG. 1 in a partially extended configuration

Referring again to FIG. 1, it will be appreciated that reduced diameter portion 25 of mandrel 5 will enable limited reciprocation of the mandrel within hydraulic housing 4 without interference from valve 14. However, as shown in FIG. 1 mandrel 5 further includes an enlarged diameter portion 18 that closely approximates the inside diameter of hydraulic valve 14 and that is positioned axially on the mandrel along the length of reduced diameter portion 25 at a point distal to cap 26. Axial movement of the mandrel within the housing to the point where hydraulic valve 14 comes into contact with enlarged diameter portion 18 will cause hydraulic valve 14 to effectively create a seal between the outer hydraulic housing and the inner mandrel, and thereby effectively bifurcate fluid chamber 8 into two separate portions. For example, when hydraulic drilling jar 1 is extended through the application of a tensile load between housing 4 and mandrel 5, the housing and the mandrel will tend to axially separate, and in so doing hydraulic valve 14 will travel longitudinally along reduced diameter portion 25 of the mandrel. Hydraulic valve 14 will move in such a fashion relatively unabated until such time as it comes into contact with enlarged diameter portion 18. At that point the valve will become seated against both the hydraulic housing and the inner mandrel surfaces and effectively bifurcate fluid chamber 8 into a first lower portion 19 and a second upper portion 20. The continued application of tensile load will cause further extension of hydraulic drilling jar 1 and force valve 14 to travel along the length of enlarged diameter portion 18 (see FIG. 6). Shoulders 15 and 16 assist in maintaining hydraulic valve 14 in a confined longitudinal relationship with respect to housing 4.

When hydraulic valve 14 is seated against both the hydraulic housing and the inner mandrel, further extension of drilling jar 1 will result in a pressurization of lower portion 19 of fluid chamber 8, since fluid contained within portion 1 effectively has no place to go while the volume of lower portion 19 decreases.

When the jar is extended in the above described fashion with hydraulic valve 14 seated against both the hydraulic housing and the inner mandrel and with lower portion 19 of fluid chamber 8 pressurized, the drilling jar is said to be in a "cocked" configuration. Further longitudinal extension of drilling jar 1 will cause further movement of hydraulic valve 14 along the surface of enlarged portion 18 of mandrel 5 and will eventually cause the valve to be moved fully past the enlarged portion. At that point there will effectively be a breaking of the seal between the valve and the inner mandrel, allowing for the rapid de-pressurization of lower portion 19 of fluid chamber 8. The de-pressurization of lower portion 19 in such a manner causes the jar to "fire" since the continuous tensile load applied to hydraulic housing 4 is no longer abated or restricted by the pressurized fluid in the lower portion of the fluid chamber. This "firing" of drilling jar 1 therefore permits a rapid further extension of the jar and a resulting high impact loading of anvil 11 upon hammer 12.

So as to prevent the over pressurization of lower portion 19 of fluid chamber 8 when hydraulic drilling jar 1 is extended, in the preferred embodiment hydraulic valve 14 includes a longitudinally oriented fluid passageway 21 therethrough. Passageway 21 allows for the controlled passage of fluid from lower portion 19 to upper portion 20 of fluid chamber 8. However, in order to maintain a sufficient fluid pressure within lower portion 19 to permit drilling jar 1 to "fire" as described above, while at the same time preventing over pressurization of the lower portion of the fluid chamber, fluid passageway 21 preferably includes pressure control means 22. Pressure control means 22 maintains the fluid pressure within first portion 19 at a pre-determined level as the drilling jar is extended, and when in a cocked position.

Pressure control means 22 preferably comprises a check valve, a flow restriction nozzle, a labyrinth passageway, or other flow restriction or pressure drop device. In the case of a check valve, any one of a variety of different check valves could be utilized wherein the valve will prevent the flow of fluid until pressures exceed the pre-determined limit of the valve. Where flow restricting nozzles or labyrinth passageways are utilized, such nozzles or passageways result in a pressure drop as fluid passes through them and thereby maintain a back pressure within lower portion 19. The flow rates through the nozzles or labyrinth passageways can be designed to permit a sufficient flow of fluid through passageway 21 so as to maintain the pressure in lower portion 19 of fluid chamber 8 within predetermined values, while preventing over pressurization of the lower portion of the chamber. It will, of course, be appreciated by those skilled in the art that in addition to the use of a single check valve, flow restricting nozzle, or labyrinth passageway more than one, or a combination, of such devices could be used simultaneously within fluid passageway 21.

In addition to pressure control means 22 (whether it be a check valve, flow restricting nozzle, labyrinth passageway, or other such device) fluid passageway 21 may include filtering means 23 to filter fluid passing therethrough. Filtering means 23 may comprise standard cartridge or mesh filters, screens, or a combination of filtering media. Typically filtering means 23 would be positioned at the lower end of fluid passageway 21 to prevent the ingress of particulate matter into the passageway and into contact with pressure control means 22.

It will thus be appreciated from an understanding of the structure as both described above and shown in the attached drawings, that the application of a tensile load to drilling jar 1 will result in extension of the jar and a pressurization of lower portion 19 of hydraulic chamber 8. In operation, a tensile load causing an extension of the drilling jar would typically be applied by pulling upwardly on the drill string where the lower portion of the drill string and/or a downhole pump or other tool is wedged within the well casing. Depending upon the particular well and the equipment that is used, the upward force applied to the drill string may vary. However, typically an upward tensile load in the range of 30,000 pounds can be expected. In such instances, pressure control means 22 may be designed to maintain pressure within lower portion 19 of fluid chamber 8 at approximately 10,000 pounds per square inch. Further upward tensile loading of the drilling jar would, as described, result in hydraulic valve 14 being drawn past enlarged diameter portion 18 of mandrel 5 causing the drilling jar to "fire" with a subsequent very rapid extension of the drilling jar, and a resulting high impact loading of hammer portion 11 upon anvil 12. That resulting high impact loading causes a sharp upward force to be applied to the mandrel, and hence the drill string and any downhole tool attached thereto. The shock of the high impact loading of the mandrel assists in freeing any set or lodged components in the well. Typically the entire tensile loading, cocking and firing of hydraulic drilling jar 1 will take approximately 20 to 30 seconds permitting the device to be fired a number of times within a short duration if necessary.

It is to be understood that what has been described are the preferred embodiments of the invention and that it may be possible to make variations to these embodiments while staying within the broad scope of the invention. Some of these variations have been discussed while others will be readily apparent to those skilled in the art. For example, while in the described embodiment hydraulic valve 14 is retained against housing 4, in an alternate embodiment valve 14 could be retained against mandrel 5. Under such a structure, hydraulic housing 4 would include a reduced internal diameter portion against which the valve would seat upon extension of the drilling jar, in a similar fashion as it seats against enlarged diameter portion 18 in the above described embodiment.

What is claimed is:

1. A hydraulic drilling jar for use in association with downhole drilling and adaptable for connection between components of a drill string, the hydraulic drilling jar comprising:

(i) an outer generally hollow hydraulic housing having an enclosed first end and an open second end, said first end releasably securable to a first component of the drill string;

(ii) an inner mandrel assembly having a first end releasably securable to a second component of the drill string and a second end slidably receivable within said open second end of said hydraulic housing thereby forming an internal fluid chamber between said mandrel and said housing, said mandrel assembly slidable within said outer housing from a contracted position to an extended position, said hydraulic housing and said mandrel assembly operatively connecting the first and second components of the drill string;

(iii) an anvil portion and a hammer portion, one of said anvil and said hammer portions situated on said hydraulic housing and the other of said anvil and said hammer portions situated on said mandrel assembly; and, (iv) a hydraulic valve received around said second end of said mandrel assembly and within said fluid chamber, wherein upon extension of said drilling jar through the application of a tensile load between said housing and said mandrel, said valve seats against said housing and said mandrel and thereby bifurcates said fluid chamber into first and second portions while pressurizing said first portion of said fluid chamber to place said hydraulic drilling jar in a cocked configuration, such that further extension of said hydraulic drilling jar through the continued application of a tensile load causes said valve to become unseated allowing for rapid de-pressurization of said first portion of said fluid chamber and a resulting rapid further extension of said hydraulic drilling jar with high impact loading of said anvil and said hammer portions.

2. The device as claimed in claim 1 wherein said valve includes a fluid passageway therethrough for controlled passage of fluid from said first portion of said fluid chamber to said second portion of said fluid chamber upon extension of said hydraulic drilling jar.

3. The device as claimed in claim 2 wherein said fluid passageway in said valve includes means to maintain the fluid pressure within said first portion of said fluid chamber at a pre-determined level when said hydraulic drilling jar is in said cocked position.

4. The device as claimed in claim 3 wherein said valve is retained against said hydraulic housing and adjacent to the surface of said mandrel assembly upon extension and retraction of said hydraulic drilling jar.

5. The device as claimed in claim 4 wherein said second end of said mandrel assembly has an increased diameter portion, said valve seating against said increased diameter portion of said mandrel upon extension of said hydraulic drilling jar and thereby bifurcating said fluid chamber into said first and second portions.

6. The device as claimed in claim 3 wherein said valve is retained against said second end of said mandrel assembly and is slidably receivable within said hydraulic housing upon the extension or retraction of said hydraulic drilling jar.

7. The device as claimed in claim 6 wherein said generally hollow interior of said hydraulic housing has a reduced internal diameter portion, said valve seating against said reduced internal diameter portion upon extension of said hydraulic drilling jar and thereby bifurcating said fluid chamber into said first and second portions.

8. The device as claimed in claim 3 wherein said means to maintain fluid pressure in said first portion of said fluid chamber at a pre-determined level comprises a check valve, a flow restricting nozzle or a labyrinth passageway.

* * * * *